US007273185B2

(12) United States Patent
Magel

(10) Patent No.: US 7,273,185 B2
(45) Date of Patent: Sep. 25, 2007

(54) DEVICE FOR ATTENUATING THE STROKE OF THE NEEDLE IN PRESSURE-CONTROLLED FUEL INJECTORS

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 315 days.

(21) Appl. No.: 10/512,688

(22) PCT Filed: Apr. 3, 2003

(86) PCT No.: PCT/DE03/01101

§ 371 (c)(1),
(2), (4) Date: Oct. 27, 2004

(87) PCT Pub. No.: WO2004/003377

PCT Pub. Date: Jan. 8, 2004

(65) Prior Publication Data

US 2006/0163378 A1 Jul. 27, 2006

(30) Foreign Application Priority Data

Jun. 29, 2002 (DE) ..... 102 29 415

(51) Int. Cl.
*F02M 47/02* (2006.01)
*F02M 59/00* (2006.01)
*F02M 45/00* (2006.01)
*F02M 61/10* (2006.01)
*B05B 1/30* (2006.01)

(52) U.S. Cl. ..... 239/88; 239/533.1; 239/533.2; 239/533.3; 239/533.4; 239/533.11; 239/585.1; 239/585.5

(58) Field of Classification Search ..... 239/88–93, 239/533.1, 533.2, 533.3, 533.4, 533.9, 533.11, 239/585.1–585.5; 251/129.15, 129.21, 127
See application file for complete search history.

(56) References Cited

U.S. PATENT DOCUMENTS 4,205,637 A * 6/1980 Ito et al. ..... 123/447
5,752,659 A * 5/1998 Moncelle ..... 239/88
6,543,706 B1 * 4/2003 Hutchings et al. ..... 239/533.3
6,793,161 B1 * 9/2004 Fujita et al. ..... 239/585.1

* cited by examiner

*Primary Examiner*—Davis Hwu
(74) *Attorney, Agent, or Firm*—Ronald E. Greigg

(57) ABSTRACT

The invention relates to a device for injecting fuel into a combustion chamber of an internal combustion engine, and which includes a fuel injector which can be acted upon by fuel at high pressure via a high-pressure source and is actuatable via a metering valve. Associated with the injection valve member is a damping element, which is movable independently of it and defines a damping chamber. The damping element has at least one overflow conduit for connecting the damping chamber to a further hydraulic chamber.

21 Claims, 2 Drawing Sheets

DEVICE FOR ATTENUATING THE STROKE OF THE NEEDLE IN PRESSURE-CONTROLLED FUEL INJECTORS

CROSS-REFERENCE TO RELATED APPLICATIONS

This application is a 35 USC 371 application of PCT/DE 03/01101 filed on Apr. 3, 2003.

BACKGROUND OF THE INVENTION

1. Field of the Invention

For supplying combustion chambers of self-igniting internal combustion engines with fuel, both pressure-controlled and stroke-controlled injection systems may be used. As the fuel injection systems, not only unit fuel injectors and pump-line-nozzle units but also common rail injection systems may be used. Advantageously, common rail injection systems (common rails) make it possible to adapt the injection pressure to the engine load and rpm. To attain high specific outputs and to reduce emissions from the engine, the highest possible injection pressure is generally required.

2. Description of the Prior Art

For reasons of strength, the feasible pressure level in common rail injection systems in use today is limited to about 1600 bar. To increase the pressure further in common rail injection systems, pressure boosters are.

European Patent Disclosure EP 0 562 046 B 1 discloses an actuation and valve assembly with damping for an electronically controlled injection unit. The actuation and valve assembly for a hydraulic unit has an electrically excitable electromagnet, with a fixed stator and a movable armature. The armature has a first and a second surface which define a first and second hollow chamber, and the first surface of the armature points toward the stator. A valve connected to the armature is capable of carrying a hydraulic actuation fluid from a sump to the injection device. Relative to one of the hollow chambers in the electromagnet assembly, a damping fluid can be collected there or drained off again from there. By means of a valve region that points into a central bore, the fluidic communication of the damping fluid can be selectively opened and closed in proportion to the viscosity of the fluid.

German Patent Disclosure DE 101 23 910.6 relates to a fuel injection device used in an internal combustion engine. The combustion chambers of the engine are supplied with fuel via fuel injectors which are acted upon via a high-pressure source; moreover, the fuel injection device of DE 101 23 910.6 has a pressure booster that has a movable pressure booster piston which divides a chamber, which can be connected to the high-pressure source, from a high-pressure chamber that communicates with the fuel injector. The fuel pressure in the high-pressure chamber can be varied by filling a back chamber of the pressure booster with fuel and emptying this back chamber of fuel.

The fuel injector includes a movable closing piston for opening and closing the injection openings that point toward the combustion chamber. The closing piston protrudes into a closing pressure chamber, so that the pressure chamber can be acted upon by fuel. As a result, a force urging the closing piston in the closing direction is generated. The closing pressure chamber and a further chamber are formed by a common work chamber, and all the portions of the work chamber communicate permanently with one another for exchanging fuel.

With this embodiment, by triggering the pressure booster via its back chamber, it can be attained that the triggering losses in the high-pressure fuel system can be kept slight, in comparison with triggering via a work chamber that communicates intermittently with the high-pressure fuel source. Moreover, the high-pressure chamber is relieved only as far as the pressure level of the high-pressure reservoir, and not to the leakage pressure level. This improves the hydraulic efficiency, on the one hand, and on the other, a faster pressure buildup to the system pressure level can take place, so that the time intervals between injection phases can be shortened considerably.

In pressure-controlled common rail injection systems with a pressure booster, the problem arises that the stability of injection quantities to be injected into the combustion chamber, and especially the realization of very small preinjection quantities, which are required in a preinjection, is not reliably assured. This can be ascribed above all to the fact that the nozzle needle opens very fast in pressure-controlled injection systems. Therefore even very slight deviations in the triggering duration of the control valve can have a major effect on the injection quantity.

With a view to increasingly stringent demands in terms of emissions and noise in self-igniting internal combustion engines, further provisions in the injection system are required, in order to meet more-stringent limit values that are expected in the near future.

SUMMARY OF THE INVENTION

With the device for injecting fuel proposed according to the invention, the opening speed of an injection valve member, such as a nozzle needle, can be damped without causing an impairment to fast closure of the injection valve member. Opening of an injection valve member that takes place at a reduced opening speed improves the minimum-quantity capability of a fuel injector considerably. If short injection intervals can be attained, then minimum quantities can be effected even in the context of multiple preinjections into the combustion chamber of an internal combustion engine.

The embodiment proposed according to the invention has no effect on a rapidly proceeding closing event of the injection valve member. Fast closure of the injection valve member has a favorable effect on emissions figures for a self-igniting internal combustion engine, since in an advanced stage of combustion, no further fuel reaches the combustion chamber of the engine. The fuel located in the combustion chamber can be converted completely; excessively high hydrocarbon values as well as soot development are suppressed by a fast closure of the injection valve member. A fast needle closure also promotes a shallow course of the characteristic curves for quantity of the fuel to be injected into the combustion chamber in the ballistic mode of the injection valve member, or in other words during the reciprocating motion between its upper stop and its seat at the combustion chamber. A shallow course of the characteristic quantity curve also increases the metering precision of the fuel to be introduced into the combustion chamber considerably, since deviations in terms of the triggering of the injection valve member do not cause a major change in the quantity of fuel to be injected. In contrast to this, deviations in the triggering of the injection valve member when the characteristic quantity curves have a steep slope cause these deviations to be associated with a major increase in the quantity of fuel injected into the combustion chamber of a self-igniting internal combustion engine.

The embodiment of the proposed device for damping an injection valve member is especially advantageous if it is provided with a further filling path. This makes it possible for a damping element to return to its outset position very quickly, and hence a damping action, that is, a reduction in the opening speed of the injection valve member, is attained and hence multiple injections in rapid succession can be realized, for instance in a double preinjection.

If the device proposed according to the invention is used in a pressure-boosted fuel injector, the result is an injection system with high injection pressure, good hydraulic efficiency, and greatly improved minimum quantity capability. The proposed device for stroke damping of an injection valve member is moreover usable in other pressure-controlled injection systems, such as unit fuel injectors, pump-line-nozzle units, and distributor injection pumps, as well as in common rail systems with fuel injectors without a pressure booster.

BRIEF DESCRIPTION OF THE DRAWINGS

The invention is described in further detail below in conjunction with the drawings in which.

DESCRIPTION OF THE PREFERRED EMBODIMENTS

Figure 1:
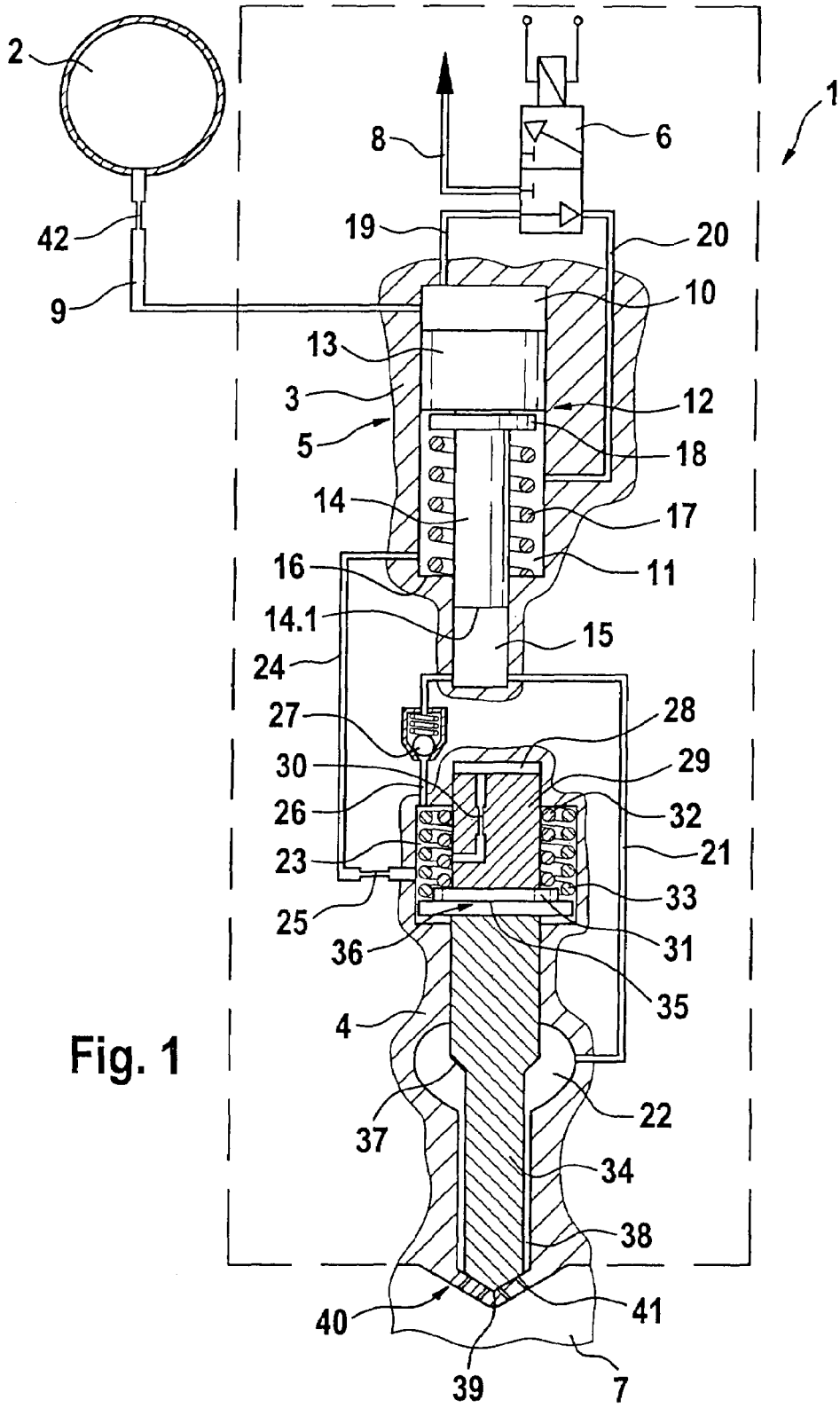
FIG. 1 is a schematic sectional view of a first variant embodiment of a device for stroke damping in an injection valve member with a filling path, embodied in the damping element, of a damping chamber.

In FIG. 1, the first variant embodiment of a device for stroke damping of an injection valve member can be seen, with a damping element which includes a filling path for a hydraulic damping chamber.

The description of the device for damping the reciprocating motion of an injection valve member according to the invention will be made in conjunction with a fuel injector with a pressure booster. The proposed device for damping the reciprocating motion can also be employed in other fuel injection systems, such as unit fuel injector systems and pump-line nozzle systems, distributor injection pumps, and high-pressure reservoir injection systems (common rail injection systems), whose fuel injectors do not include a pressure booster.

The pressure-boosted fuel injector 1 shown in FIG. 1 is supplied with fuel at high pressure via a high-pressure reservoir 2 (common rail), shown only schematically here. From the interior of the high-pressure reservoir 2, a supply line 9 extends to a pressure booster 5, which is integrated with the fuel injector 1 in the variant embodiment shown in FIG. 1. The pressure booster 5 is surrounded by an injector body 3 of the fuel injector 1. The fuel injector 1 further includes a metering valve 6, which in the variant embodiment of the fuel injector shown in FIG. 1 is embodied as a 3/2-way valve. Instead of a 3/2-way valve schematically shown here, a 2/2-way valve may also be employed. The metering valve 6 may be embodied as a magnet valve or may be actuated via a piezoelectric actuator. The metering valve 6 may also be embodied as a servo valve or as a direct-switching valve. In the lower region of the fuel injector 1, adjoining the injector body 3, a nozzle body 4 is embodied that receives an injection valve member 34 by way of which the fuel, at high pressure, is injected into the combustion chamber 7 of a self-igniting internal combustion engine. The injection valve member 34 may be embodied as a nozzle needle configured in one piece or in multiple parts. From the metering valve 6, a return on the low-pressure side identified by reference numeral 8 leads to a fuel reservoir, not shown in FIG. 1, such as the fuel tank of a motor vehicle.

The pressure booster 5 that can be acted upon via the supply line 9, with which a throttle restriction 42 that damps pressure pulsations may be integrated, via the high-pressure reservoir 2 (common rail) includes a work chamber 10, into which the supply line 9 discharges. The pressure booster 5 further includes a control chamber 11. The work chamber 10 and the control chamber 11 of the pressure booster 5 are separated from one another by a piston unit 12. In the variant embodiment of the pressure booster shown in FIG. 1, the piston unit 12 includes a first partial piston 13 and a second partial piston 14. The lower face end 14.1 of the second partial piston 14 acts on a compression chamber 15 of the pressure booster 5. A restoring spring element 17 is received in the control chamber 11 of the pressure booster 5 and is braced on one end on the bottom face, acting as an abutment 16, of the control chamber 11, or in other words on an annular face inside the injector body 3, and on the other end, it rests on a stop 18 embodied on the second partial piston 14. The piston unit 12 of the pressure booster 5 can be embodied either as a one-piece component or—as shown in FIG. 1—as a multi-part component. The diameter of the first partial piston 13 is embodied as greater than the diameter of the second partial piston 14, whose lower face end 14.1 defines the compression chamber 15 of the pressure booster 5.

From the work chamber 10 of the pressure booster 5, a supply line 19 leads to the metering valve 6, which in the position shown in FIG. 1 is in its open position, so that fuel flows from the work chamber 10 via the supply line 19 to the metering valve 6 and via a control line 20 into the control chamber 11 of the pressure booster 5.

The compression chamber 15 of the pressure booster 5, which can be subjected to pressure via the second partial piston 14, communicates via a connecting line 21 with a nozzle chamber 22 embodied in the nozzle body 4 of the fuel injector 1. The nozzle chamber 22 surrounds the injection valve member 34, preferably embodied as a nozzle needle, in the region of a pressure shoulder 37 embodied on the outer circumference of the injection valve member 34. From the nozzle chamber 22, an annular gap 38 extends in the direction of the tip 39 of the injection valve member. The fuel, which is at very high pressure, in the nozzle chamber 22 flows along this annular gap 38 to the seat 40 at the combustion chamber of the injection valve member 34. Injection openings 41 that discharge into the combustion chamber 7 of a self-igniting internal combustion engine are embodied below the seat 40 of the injection valve member at the combustion chamber. The injection openings 41 are preferably embodied as concentric circles of holes, so that fine atomization of the fuel introduced into the combustion chamber 7 is assured.

On the side opposite the seat 40 at the combustion chamber of the injection valve member 34, a further hydraulic chamber 23 is associated with the injection valve member 34. The further hydraulic chamber 23 receives both a first spring element 32 and a second spring element 33. The second spring element 33 acts on one face end 35 of the injection valve member. The second spring element 33 is braced on the top of the further hydraulic chamber 23 inside the nozzle body 4 of the fuel injector 1.

A damping element 29, which may for instance be embodied in piston form, is received in the further hydraulic chamber 23. With its face end remote from the face end 35 of the injection valve member 34, the damping element 29 defines a damping chamber 28. The damping element 29 is movable toward the injection valve member 34, independently of the stroke of this injection valve member. On its face end remote from the damping chamber 28, the damping element 29 includes an annular face 31. The first spring element 32 is braced on the annular face of the damping element 29 and is braced with its opposite end, analogously to the second spring element 33, on the top of the further hydraulic chamber 23 inside the nozzle body 4. In the further hydraulic chamber 23, the damping element 29 and the face end 34 contact one another along a dividing line 36. In the variant embodiment shown in FIG. 1, the faces that form the dividing line 36, that is, the underside of the annular face 31 and the face end 35 in the top region of the injection valve member 34, are embodied as plane faces.

From the further hydraulic chamber 23, a filling path 26, in which a check valve 27 is disposed, extends to the compression chamber 15 of the pressure booster 5, which can be filled with fuel through the filling path 26. The further hydraulic chamber 23 furthermore communicates with the control chamber 11 of the pressure booster 5 via an overflow line 24.

In the state of repose of the fuel injection system shown in FIG. 1, the metering valve 6 is not triggered, and no injection takes place on the end toward the combustion chamber of the injection valve member 34 into the combustion chamber 7 of the self-igniting internal combustion engine. The pressure prevailing in the interior of the high-pressure reservoir 2 (common rail) also prevails via the supply line 9 in the work chamber 10 of the pressure booster 5. Moreover, the pressure prevailing in the work chamber 10 prevails via the supply line 19 in the metering valve 6 and by way of it, via the control line 20, in the control chamber 11 of the pressure booster 5 as well. Furthermore, the pressure prevailing in the control chamber 11 of the pressure booster 5, which is equivalent to the pressure prevailing in the interior of the high-pressure reservoir 2 (common rail), also prevails via the overflow line 24 in the further hydraulic chamber 23 inside nozzle body 4. Via the filling path 26 with the check valve 27 contained in it, the rail pressure, that is, the pressure prevailing in the interior of the high-pressure reservoir 2, also prevails in the compression chamber 15 of the pressure booster 5 and, via the connecting line 21, also in the nozzle chamber 22 that surrounds the injection valve member 34. The pressure prevailing in the interior of the further hydraulic chamber 23 also prevails, via a overflow conduit 30 that includes a throttle restriction, in the damping chamber 28 that is defined by one face end of the damping element 29.

Accordingly, in the basic state, all the chambers 10, 11 and 15 that can be acted upon hydraulically in the pressure booster 5 are acted upon by rail pressure, that is, by the pressure level prevailing in the interior of the high-pressure reservoir 2, and the piston unit 12 inside the pressure booster 5 is in its pressure-balanced state. In this state, the pressure booster 5 is deactivated, and no pressure boosting takes place. Also in this state, the piston unit 12 of the pressure booster 5 is kept in the outset position via a restoring spring element 17. The compression chamber 15 is filled with a fuel volume from the further hydraulic chamber 23 via the filling line 26 branching off from it and having an integrated check valve 27. By means of the pressure prevailing in the further hydraulic chamber 23, a hydraulic closing force is exerted on the injection valve member 34. The hydraulic force acting on the injection valve member 34 and engaging its face end 35 can be reinforced by the spring force of the second spring element 33. Therefore the pressure prevailing in the interior of the high-pressure reservoir 2, or in other words the rail pressure, can always prevail in the pressure chamber 22 (nozzle chamber) surrounding the injection valve member 34, without causing the injection valve member 34 to open the injection openings 41 to the combustion chamber 7 of the self-igniting internal combustion engine unintentionally.

The metering of the fuel is effected by means of a relief of the control chamber 11 of the pressure booster 5 via an activation or in other words triggering of the metering valve 6, which is embodied for instance as a 3/2-way valve. By an activation of the metering valve 6 into its closing position, the control chamber 11 is disconnected from the system power supply, that is, from the high-pressure reservoir 2 and the supply line 19 to the metering valve 6, and is made to communicate with the return 8 on the low-pressure side. The pressure in the control chamber 11, which is also known as a back chamber, decreases, and as a result the pressure booster 5 is activated, and the pressure in the compression chamber 15 and hence, because of the connecting line 21, in the pressure chamber 22 as well increases. Also as a result, the hydraulic force engaging the injection valve member 34 on its pressure shoulder 37 in the opening direction increases; simultaneously, the pressure in the further hydraulic chamber 23, because of its communication with the pressure-relieved control chamber 11 of the pressure booster 5 via the overflow line 24, is reduced, and as a result the pressure force acting in the closing direction on the face end 35 of the injection valve member 34 lessens.

Because of the increasing hydraulic force that engages the pressure shoulder 37 of the injection valve member 34 in the pressure chamber 22, the injection valve member 34 opens in pressure-controlled fashion and uncovers the injection openings 41 at the tip 39, toward the combustion chamber, of the injection valve member 34. In the opening stroke motion of the injection valve member 34, its face end 35, which rests along the abutting seam 36 on the annular face 31 of the damping element 29, presses the injection valve member upward, so that its face end remote from the face end 35 of the injection valve member 34 moves into the damping chamber 28. The fuel volume contained in the damping chamber 28 flows, via the overflow conduit 30 that includes a throttle restriction, into the further hydraulic chamber 23 and is accordingly positively displaced into the further hydraulic chamber 23 via the overflow line 30. Because of this positive displacement, a damping force that counteracts an excessively rapid upward motion of the injection valve member 34 ensues. This causes a slowdown in the opening speed of the injection valve member 34. The needle opening speed can be varied by way of the design or in other words the flow cross section of the throttle restriction that is included in the overflow line 30.

As long as the control chamber 11 of the pressure booster 5 remains pressure-relieved and the pressure booster 5 is activated, the fuel in the compression chamber 15 of the pressure booster is compressed. The fuel, compressed in the compression chamber 15 by the movement of the second partial piston 14 inward with its face end 14.1 in the compression chamber 15, flows via the connecting line 21 into the pressure chamber 22 in the nozzle body 4 and from there along the annular gap 38 in the direction of the opened injection openings 41 and atomizes in the combustion chamber 7 of the self-igniting internal combustion engine.

For terminating the injection, upon renewed activation of the metering valve 6 in its switching position shown in FIG. 1, the control chamber 11 of the pressure booster 5 is disconnected from the return 8 on the low-pressure side again and is made to communicate with the supply line 19 to the metering valve 6, as a result of which the control chamber 11 of the pressure booster 5 is again acted upon by the pressure level prevailing in the high-pressure reservoir 2 (common rail). As a result, both in the control chamber 11 and in the further hydraulic chamber 23, the pressure level prevailing in the interior of the high-pressure reservoir 2 builds up. The second partial piston 14, which has moved with its face end 14.1 into the compression chamber 15 of the pressure booster 5, is pressure-balanced as a result of the subjection of the control chamber 11 to pressure, and as a result the pressure in the compression chamber 15 and hence in the pressure chamber 22 decreases. Since because of the communication of the control chamber 11 with the further hydraulic chamber 23 via the overflow line 24, the pressure level prevailing in the interior of the high-pressure reservoir 2 also prevails in the further hydraulic chamber 23, the injection valve member 34 is now hydraulically balanced and is closed by the spring, disposed in the further hydraulic chamber 23 and acting on the face end 35 of the injection valve member 34, and is pressed into the seat 40 at the combustion chamber. As a result, the injection of fuel into the combustion chamber 7 of the engine via the injection openings 41 is terminated. Given an appropriate hydraulic design, it is also possible to dispense with the spring that acts on the face end 35 of the injection valve member 34, or in other words the second spring element 33, since in that case, a hydraulic closing force can be generated during the closure of the injection valve member 34, or in other words during its movement inward into the seat 40 at the combustion chamber.

The injection valve member 35 can disconnect itself from the annular face 31 of the damping element 29 as it moves into the seat 40 at the combustion chamber, or in other words upon closure. This assures a fast and damped closure of the injection valve member 34 into its position that closes the injection openings 41 to the combustion chamber 7. To reduce the closing speed of the injection valve member 35, a throttle restriction 25 may be provided in the overflow line 24 between the control chamber 11 of the pressure booster and the further hydraulic chamber 23. After the pressure equalization of the system, the piston unit 12 of the pressure booster is returned to its outset position by the restoring spring 17, whereupon filling of the compression chamber 15 can take place via the further hydraulic chamber 23, by means of the aforementioned filling path 26 with the integrated check valve 27. The damping element 29, preferably embodied as a damping piston, is restored to its outset position by the first spring element 32 that acts on the annular face 31, and refilling of the damping chamber 28 takes place from the further hydraulic chamber 23, via the overflow conduit 30 with the throttle restriction.

Figure 2:
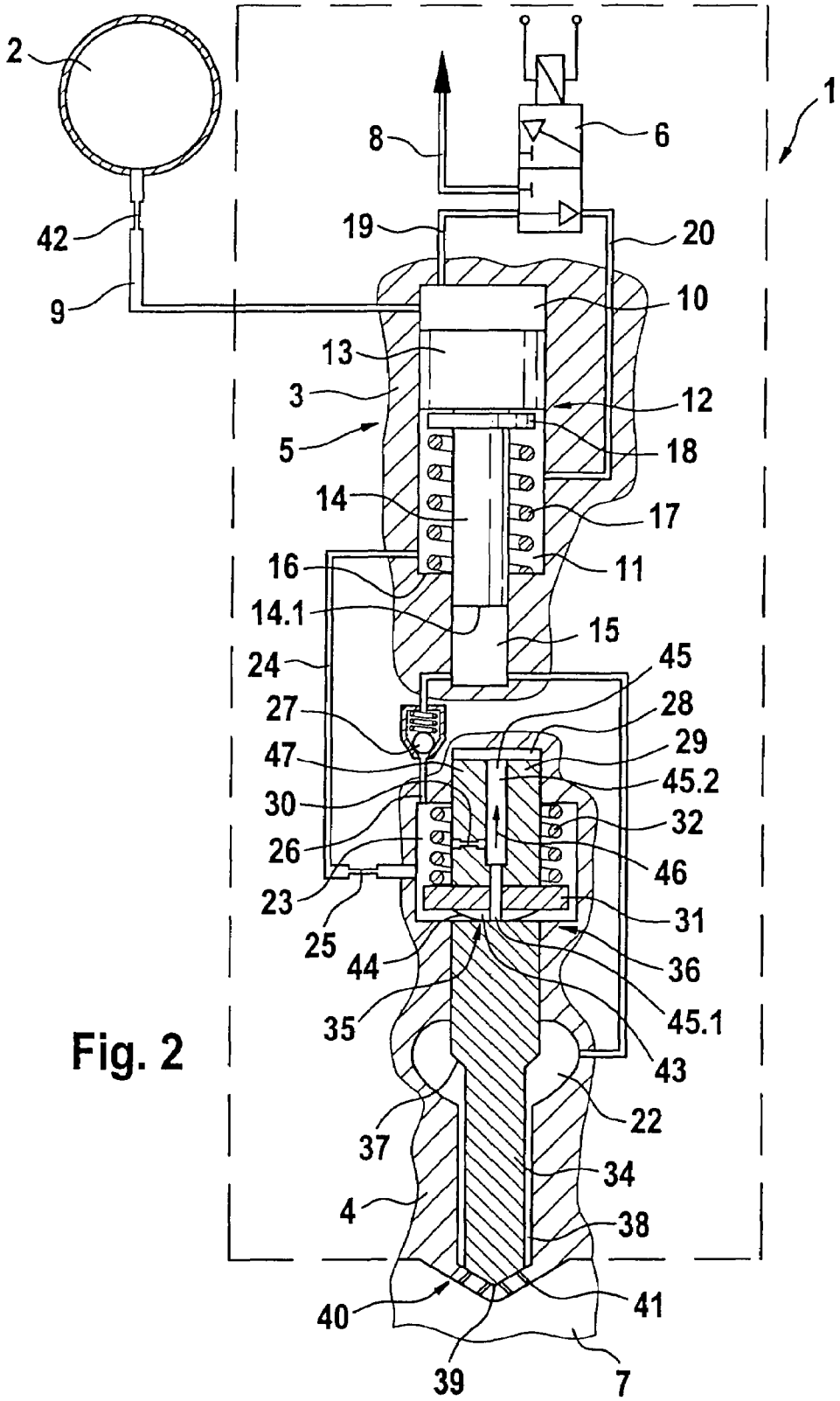
FIG. 2, a further embodiment of a device for stroke damping of an injection valve member, having a damping element which includes two filling paths for filling a hydraulic damping chamber.

FIG. 2 shows a further variant embodiment of a device for stroke damping of an injection valve member, with two filling paths provided in the hydraulic damping element.

The further variant embodiment shown in FIG. 2 of the device proposed according to the invention for damping the stroke motion of the injection valve member 34 is essentially equivalent, in terms of its structure and mode of operation, to the variant embodiment of the invention described in conjunction with FIG. 1.

In a distinction from the device shown in FIG. 1 for damping the stroke motion of an injection valve member 34, what is shown with the variant embodiment in FIG. 2 is a further version of a damping element 29 which is also effective for multiple injections in rapid succession, for instance as in the case of a double preinjection. The variant shown in FIG. 2 of the embodiment proposed according to the invention differs from the variant embodiment shown in FIG. 1 in that the damping chamber 28 in the injector of the nozzle body 4 can be filled via a further, larger filling conduit 45.

In a distinction from the variant embodiment of the damping element 29 shown in FIG. 1, the damping element 29 shown in FIG. 2 has a sealing face 43 on its end face oriented toward the face end 35 of the injection valve member 34. The sealing face 43 may be provided with a spherical contour 44, as shown in FIG. 2. The flow conduit 45 that penetrates the damping element 29 of FIG. 2 discharges on one end at the face end that defines the damping chamber 28 and on the other at the sealing face 43 with the spherical contour 44 below the annular face 31. The overflow conduit 45 that penetrates the damping element 29 coaxially to its line of symmetry includes a first conduit portion 45.1 and a second conduit portion 45.2. In comparison to the second, further conduit portion 45.2, the first conduit portion 45.1 is embodied with a reduced diameter, and as a result the first conduit portion 45.1 can be assigned a throttling function. Thus recoiling of the damping element 29 can be prevented.

Analogously to the damping element 29 shown in FIG. 1, the damping element shown in FIG. 2 is acted upon via a first spring element 32, which is braced on one end on the top of the further hydraulic chamber 23 in the nozzle body 4 and on the other on the inside of the annular face 31 of the damping element 29.

Upon opening of the injection valve member 34 by means of a pressure buildup in the pressure chamber 22, resulting from the inflow of fuel from the compression chamber 15 into the pressure chamber 22 via the connecting line 21 and a pressure force acting on the pressure shoulder 37 of the injection valve member 34, the injection valve member 34 moves in the opening direction into the further hydraulic chamber 23. In the process, the sealing face 43 on the underside of the annular face 31 is closed. Thus the flow conduit 45.1 in the interior of the damping element 29 is closed. The fuel positively displaced out of the damping chamber 28 can flow out into the further hydraulic chamber 23 only via the second conduit portion 45.2 and the overflow line, with a throttle restriction 30, that penetrates a wall 47 of the damping element 29. In this way, the opening speed of the injection valve member 34 is limited and is dependent on the configuration of the throttle restriction, that is, its control of flow through the wall 47 of the damping element 29. Upon closure of the injection valve member 34, its face end 35 separates from the sealing face 43 on the underside of the annular face 31 of the damping element 29. As a result, the opening of the flow conduit 45.1 of the damping element 29 in the sealing face 43 is uncovered, causing fuel to flow into the damping chamber 28 via the first conduit portion 45.1 and the second conduit portion 45.2. In this way, a rapid filling of the damping chamber 28 takes place, so that the damping element 29, preferably embodied as a damping piston, returns to its outset position. In this way damping of the opening speed of the injection valve member 35 in its opening motion can be achieved, yet its fast closure is unimpaired by the device, proposed according to the invention, for damping the reciprocating motion of the injection valve member 35.

In a modification of the variant embodiments shown, the overflow line 24 can communicate, instead of with the control chamber 11 of the pressure booster 5, with the work chamber 10 of the pressure booster instead. Moreover, filling of the compression chamber 15 of the pressure booster via the filling path 26 can be realized, instead of from the chamber 23, from the control chamber 11 or the work chamber 10 of the pressure booster 5.

The characterization and description of the device, proposed according to the invention, for damping the opening speed of an injection valve member 34, preferably configured as a nozzle needle, has been described above in terms of a pressure-boosted fuel injector 1 with a pressure booster 5. The device proposed according to the invention, whether it is provided with an overflow line 30 between the damping chamber 28 and the further pressure chamber 23 or is provided with two differently configured filling paths 30 and 45, can also be employed in other pressure-controlled fuel injection components, such as unit fuel injectors and distributor injection systems. Moreover, the embodiment proposed according to the invention for damping the opening speed of an injection valve member 34 can also be employed, while retaining its fast closure speed into a seat 40 at the combustion chamber, in fuel injectors 1 of reservoir injection systems that are designed without a pressure booster 5.

The foregoing relates to preferred exemplary embodiments of the invention, it being understood that other variants and embodiments thereof are possible within the spirit and scope of the invention, the latter being defined by the appended claims.

The invention claimed is:

1. A device for injecting fuel into a combustion chamber (7) of an internal combustion engine, the device comprising a fuel injector (1), which can be acted upon with fuel at high pressure via a high-pressure source (2) and is actuatable via a metering valve (6), an injection valve member (34) surrounded by a pressure chamber (22), the injection valve member (34) being urged in the closing direction by a closing force, a damping element (29) associated with and movable independently of the injection valve member (34)

the damping element (29) defining a damping chamber (28) and having at least one overflow conduit (30, 45) for connecting the damping chamber (28) to a further hydraulic chamber (23), further comprising a second spring element (33) received in the further hydraulic chamber (23) and urging the injection valve member (34) in the closing direction and pressing it into its seat (40) at the combustion chamber.

2. The device for injecting fuel of claim 1, wherein the damping element (29) that defines the damping chamber (28) is embodied as a damping piston, which is surrounded by the further hydraulic chamber (23).

3. The device for injecting fuel of claim 1, wherein the damping element (29) and the injection valve member (34) contact one another along a dividing line (36).

4. The device for injecting fuel of claim 3, further comprising a sealing face on the damping element (29) opposite a face end (35) of the injection valve member (34) is embodied as a sealing face.

5. The device for injecting fuel of claim 3, wherein the damping element (29) comprises a flow conduit (30) embodied in a wall (47).

6. The device for injecting fuel of claim 1, wherein the damping element (29) is prestressed via a first spring element (32), which is braced on an annular face (31) adjoining the injection valve member (34).

7. The device for injecting fuel of claim 1, wherein the damping element (29) further comprises overflow conduit (30) that includes a throttle restriction.

8. The device for injecting fuel of claim 7, wherein the overflow conduit (30) discharges into the further hydraulic chamber (23) at a side of the damping element (29) defining the damping chamber (28) and at the outer face of the damping element (29).

9. A device for injecting fuel into a combustion chamber (7) of an internal combustion engine, the device comprising a fuel injector (1), which can be acted upon with fuel at high pressure via a high-pressure source (2) and is actuatable via a metering valve (6), an injection valve member (34) surrounded by a pressure chamber (22), the injection valve member (34) being urged in the closing direction by a closing force, a damping element (29) associated with and movable independently of the injection valve member (34)

the damping element (29) defining a damping chamber (28) and having at least one overflow conduit (30, 45) for connecting the damping chamber (28) to a further hydraulic chamber (23) further comprising a pressure booster (5) having a compression chamber (15) and a piston unit (12), a connecting line (21) connected between the compression chamber (15) and the pressure chamber (22) and subjecting the pressure chamber (22) to fuel that is at high pressure, the compression chamber (15), in turn, being acted upon by the piston unit (12).

10. The device for injecting fuel of claim 9, further comprising a sealing face (43) on the damping element (29) opposite a face end (35) of the injection valve member (34), the sealing face (43) having a spherical contour (44).

11. The device for injecting fuel of claim 9, wherein the damping element (29) comprises a continuous flow conduit (45), which discharges in the damping chamber (28) and at a sealing face (43) in the region of the dividing line (36).

12. The device for injecting fuel of claim 11, wherein the continuously extending flow conduit (45) comprises first and second conduit portions (45.1, 45.2) having different flow cross sections.

13. The device for injecting fuel of claim 12, wherein the first conduit portion (45.1) serves the continuous flow conduit (45) as a throttle restriction.

14. The device for injecting fuel of claim 9, wherein the piston unit (12) includes a first partial piston (13) and a second partial piston (14) and divides a work chamber (10) and a control chamber (11), which can be made to communicate with a return (8) on the low-pressure side from one another.

15. The device for injecting fuel of claim 14, wherein a pressure change in the control chamber (11) of the pressure booster (5) causes a pressure change in a compression chamber (15).

16. The device for injecting fuel of claim 15, wherein, when the metering valve (6) is deactivated, a fluidic communication exists from the high-pressure reservoir (2) to the further hydraulic chamber (23).

17. The device for injecting fuel of claim 14, further comprising a filling path (26) branching off from the further hydraulic chamber (23), wherein the compression chamber (15) can be filled via the filling path (26), and wherein the further hydraulic chamber (23) communicates with the control chamber (11) of the pressure booster (5) via an overflow line (24).

18. The device for injecting fuel of claim 17, wherein the filling path (26) to the compression chamber (15) contains a check valve (27).

19. The device for injecting fuel of claim 17, wherein the overflow line (24) between the control chamber (11) of the pressure booster (5) and the further hydraulic chamber (23) contains a throttle restriction (25).

20. The device for injecting fuel of claim 9, wherein, when the metering valve (6) is deactivated, a fluidic communication exists from the high-pressure reservoir (2) to the pressure chamber (22).

21. A device for injecting fuel into a combustion chamber (7) of an internal combustion engine, the device comprising a fuel injector (1), which can be acted upon with fuel at high pressure via a high-pressure source (2) and is actuatable via a metering valve (6), an injection valve member (34) surrounded by a pressure chamber (22), the injection valve member (34) being urged in the closing direction by a closing force, a damping element (29) associated with and movable independently of the injection valve member (34)

the damping element (29) defining a damping chamber (28) and having at least one overflow conduit (30, 45) for connecting the damping chamber (28) to a further hydraulic chamber (23), further comprising a filling path (26) branching off from the further hydraulic chamber (23), and an overflow line (24) also branching off from the further hydraulic chamber.

* * * * *